US008373600B2

(12) United States Patent
Chang

(10) Patent No.: US 8,373,600 B2
(45) Date of Patent: Feb. 12, 2013

(54) SINGLE-BAND ANTENNA

(75) Inventor: Jin-Su Chang, Hsinchu County (TW)

(73) Assignee: Arcadyan Technology Corporation, Hsinchu (TW)

( * ) Notice: Subject to any disclaimer, the term of this patent is extended or adjusted under 35 U.S.C. 154(b) by 344 days.

(21) Appl. No.: 12/896,208

(22) Filed: Oct. 1, 2010

(65) Prior Publication Data

US 2011/0080324 A1 Apr. 7, 2011

(30) Foreign Application Priority Data

Oct. 2, 2009 (TW) ..... 98133580 A

(51) Int. Cl.
*H01Q 1/38* (2006.01)

(52) U.S. Cl. ..... 343/700 MS; 343/895; 343/702

(58) Field of Classification Search ..... None
See application file for complete search history.

(56) References Cited

U.S. PATENT DOCUMENTS

| | | | | |
|---|---|---|---|---|
| 7,345,647 | B1 | 3/2008 | Rodenbeck | |
| 7,345,650 | B2 * | 3/2008 | Bae et al. | 343/895 |
| 2003/0080904 | A1 * | 5/2003 | Chen | 343/700 MS |
| 2003/0214441 | A1 * | 11/2003 | Back et al. | 343/700 MS |
| 2005/0122267 | A1 * | 6/2005 | Sim et al. | 343/702 |

* cited by examiner

*Primary Examiner* — Trinh Dinh
(74) *Attorney, Agent, or Firm* — WPAT PC; Justin King

(57) ABSTRACT

A single-band antenna, comprising: a substrate; a first radiation unit; a conductive material; an impedance matching circuit; a signal feed-in terminal; a second radiation unit; and a wire connecting unit. Therefore, the single-band antenna can be miniaturized to be installed with or inside a compact wireless transmission device with enhanced transceiving performance.

13 Claims, 10 Drawing Sheets

SINGLE-BAND ANTENNA

RELATED APPLICATIONS

This application claims priority under 35 U.S.C. 119 from TAIWAN application 098133580 filed Oct. 2, 2009, the contents of which are incorporated herein by references.

BACKGROUND OF THE INVENTION

1. Field of the Invention

The present invention generally relates to a single-band antenna and, more particularly, to a single-band antenna that can be miniaturized to be installed with or inside a compact wireless transmission device with enhanced transceiving performance.

2. Description of the Prior Art

In highly developed modern days, to meet the requirement for communications, there have been reported compact antennas used in more-and-more compact hand-held electronic devices such as mobile phones or notebook computers or wireless communication devices such as access points (APs). However, the currently available single-band antenna suffers from effective operating bandwidth insufficiency due to its poorly designed structure that limits its transceiving performance.

Therefore, there exists a need in providing a single-band antenna that can be miniaturized to be installed with or inside a compact wireless transmission device with enhanced transceiving performance.

SUMMARY OF THE INVENTION

It is one object of the present invention to provide a single-band antenna that can be miniaturized to be installed with or inside a compact wireless transmission device with enhanced transceiving performance.

In order to achieve the foregoing object, the present invention provides a single-band antenna, comprising: a substrate being provided with a first side and a second side; a first radiation unit being a zig-zag pattern disposed on the first side; a conductive material being disposed on the first side; an impedance matching circuit being disposed on the first side to electrically connect the first radiation unit and the conductive material; a signal feed-in terminal being disposed on the first side and being coupled to the first radiation unit; a second radiation unit being disposed on the second side; and a wire connecting unit being disposed in the substrate to electrically connect the first radiation unit and the second radiation unit.

Preferably, the first side and the second side are two symmetric planes of the substrate.

Preferably, the first side and the second side are symmetric and non-coplanar.

Preferably, the signal feed-in terminal is connected to the second terminal of the first radiation unit.

Preferably, the impedance matching circuit and the first radiation unit are connected near the signal feed-in terminal.

Preferably, the conductive material is a grounding plane.

Preferably, the single-band antenna further comprises a coaxial cable electrically connected to the signal feed-in terminal for signal transmission.

Preferably, the single-band antenna further comprises a micro-strip line electrically connected to the signal feed-in terminal for signal transmission.

Preferably, the single-band antenna further comprises a coplanar waveguide electrically connected the signal feed-in terminal for signal transmission.

Preferably, the substrate, the first radiation unit, the conductive material, the impedance matching circuit and the signal feed-in terminal are formed in one process.

Preferably, the substrate is a printed circuit board.

Therefore, the single-band antenna can be miniaturized to be installed with or inside a compact wireless transmission device with enhanced transceiving performance.

BRIEF DESCRIPTION OF THE DRAWINGS

The objects, spirits and advantages of the embodiment of the present invention will be readily understood by the accompanying drawings and detailed descriptions, wherein.

DETAILED DESCRIPTION OF THE PREFERRED EMBODIMENT

The present invention can be exemplified by the embodiment as described hereinafter.

Figure 1:
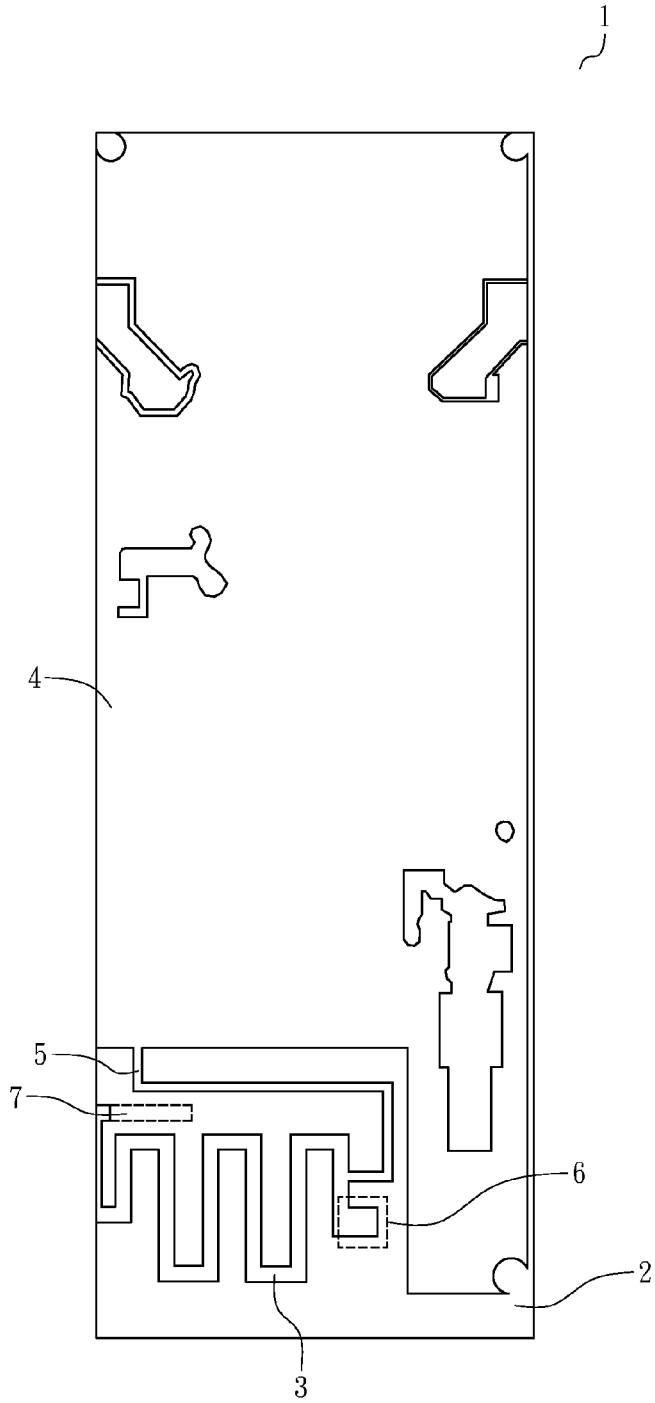
FIG. 1 is a front view of a single-band antenna according to one embodiment of the present invention.
Figure 2:
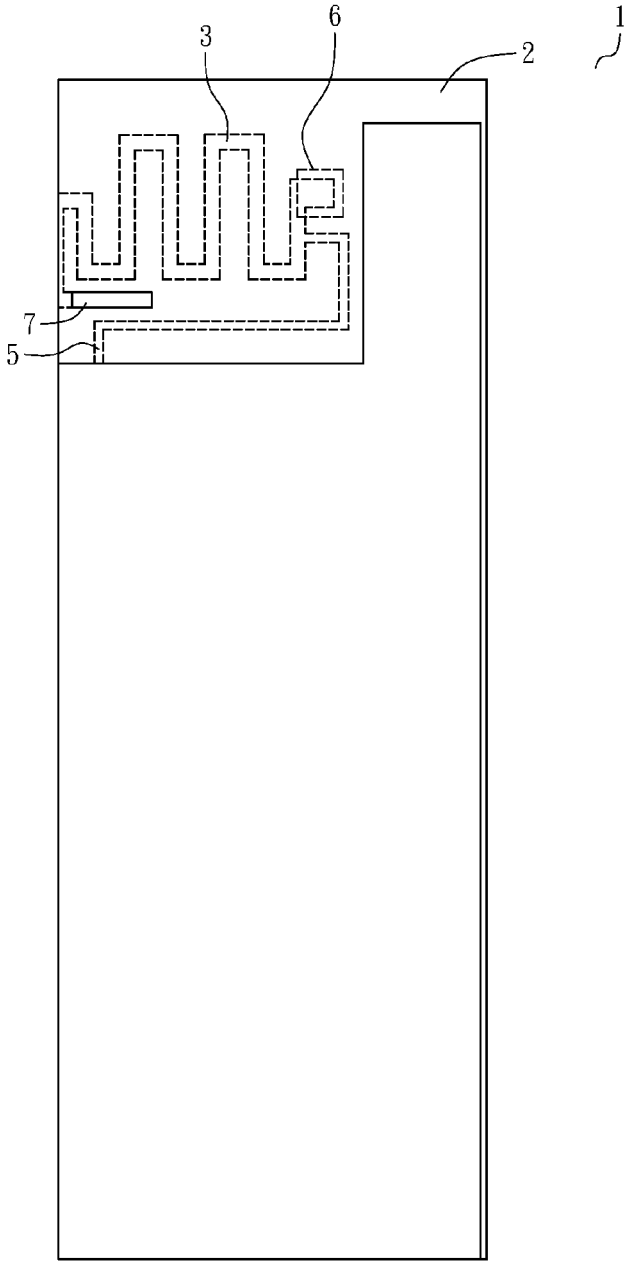
FIG. 2 is a rear view of a single-band antenna according to one embodiment of the present invention.
Figure 3:
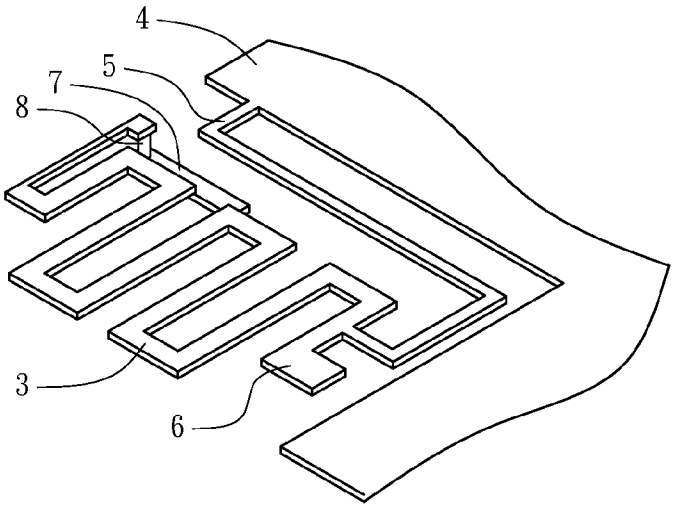
FIG. 3 is a 3-D view of a single-band antenna according to one embodiment of the present invention.

FIG. 1, FIG. 2 and FIG. 3 are respectively a front view, a rear view and a 3-D view of single-band antenna according to one embodiment of the present invention. Referring to FIG. 1, FIG. 2 and FIG. 3, the present invention provides a single-band antenna 1, comprising: a substrate 2 (for example, a printed circuit board); a first radiation unit 3; a conductive material 4; an impedance matching circuit 5; a signal feed-in terminal 6; a second radiation unit 7; and a wire connecting unit 8.

The substrate 2 is provided with a first side and a second side. The first side and the second side can be two symmetric and/or non-coplanar planes of the substrate. The first radiation unit 3 is disposed on the first side. The first radiation unit 3 is a zig-zag pattern. Generally, the first radiation unit 3 comprises a first terminal and a second terminal, and the zig-zag pattern is disposed between the first terminal and the second terminal. The conductive material 4 is disposed on the first side. The conductive material is typically a grounding plane. The impedance matching circuit 5 is disposed on the first side to electrically connect the first radiation unit 3 and the conductive material 4 for grounding so as to adjust the position where the impedance matching circuit 5 and the first radiation unit 3 are electrically connected, to change the position where the impedance matching circuit 5 and conductive material 4 are electrically connected, or to change the length or width of the impedance matching circuit 5. Thereby, the impedance, the band-width and the standing wave ratio of the antenna can be changed. The signal feed-in terminal 6 is disposed on the first side and is coupled to the first radiation unit 3. For better transmission performance, it is preferable that the single-band antenna 1 further comprises a coaxial cable, a micro-strip line or a coplanar waveguide electrically connected to the signal feed-in terminal 6. The signal feed-in terminal 6 and the impedance matching circuit 5 are not overlapped. More particularly, the impedance matching circuit 5 and the first radiation unit 3 are connected near the signal feed-in terminal 6. The second radiation unit 7 is disposed on the second side. The length of the second radiation unit 7 is not limited and can be adjusted according to practical use. The wire connecting unit 8 is disposed in the substrate 2 to electrically connect the first radiation unit 3 and the second radiation unit 7. Preferably, the wire connecting unit 8 is connected to the first terminal of the first radiation unit 3. The signal feed-in terminal 6 is connected to the second terminal of the first radiation unit 3. Generally, it is preferable that the substrate 2, the first radiation unit 3, the conductive material 4, the impedance matching circuit 5 and the signal feed-in terminal 6 are formed as a metal structure in one process to achieve better performance with lowered manufacturing cost of the single-band antenna.

Figure 4:
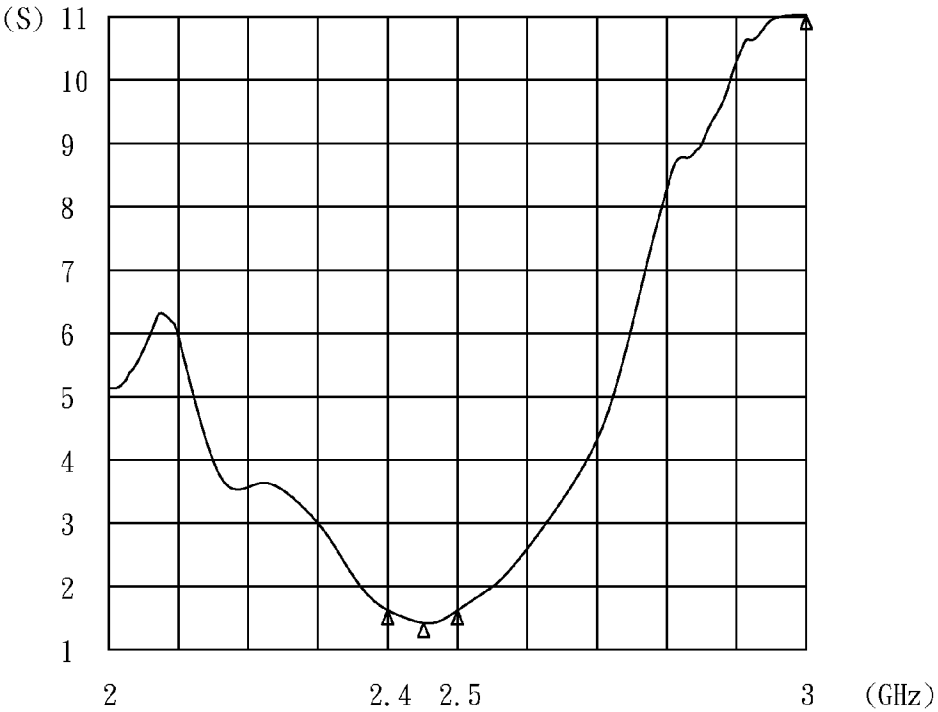
FIG. 4 shows the relation of measured voltage-standing-wave ratio (VSWR) to frequency from 2 GHz to 3 GHz according to the preferred embodiment of the present invention.

FIG. 4 shows the relation of measured voltage-standing-wave ratio (VSWR) to frequency from 2 GHz to 3 GHz according to the preferred embodiment of the present invention. Referring to FIG. 4, in the working frequency range from 2.4 GHz to 2.5 GHz of currently available wireless products, it shows that the single-band antenna of the present invention exhibits excellent transceiving performances. More importantly, the single-band antenna of the present invention is more compact than conventional single-band antennas.

Figure 5A:
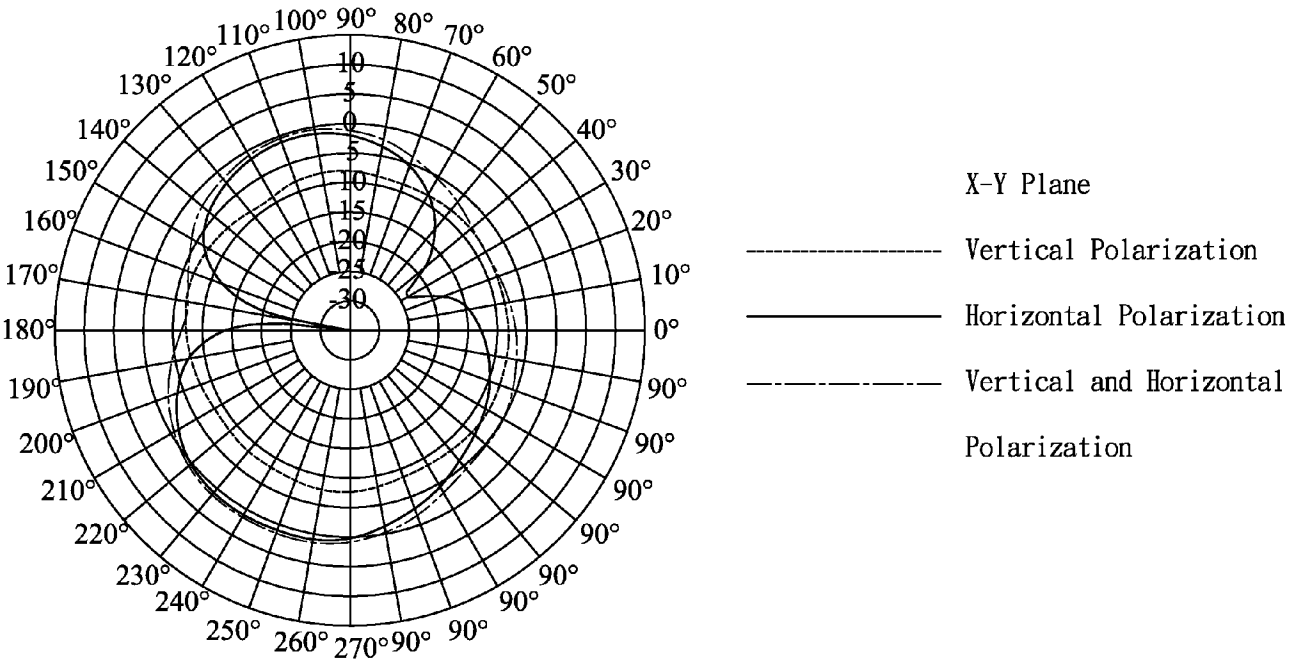
FIG. 5A shows the field pattern of a single-band antenna at 2.4 GHz on the X-Y plane according to the preferred embodiment of the present invention.
Figure 5B:
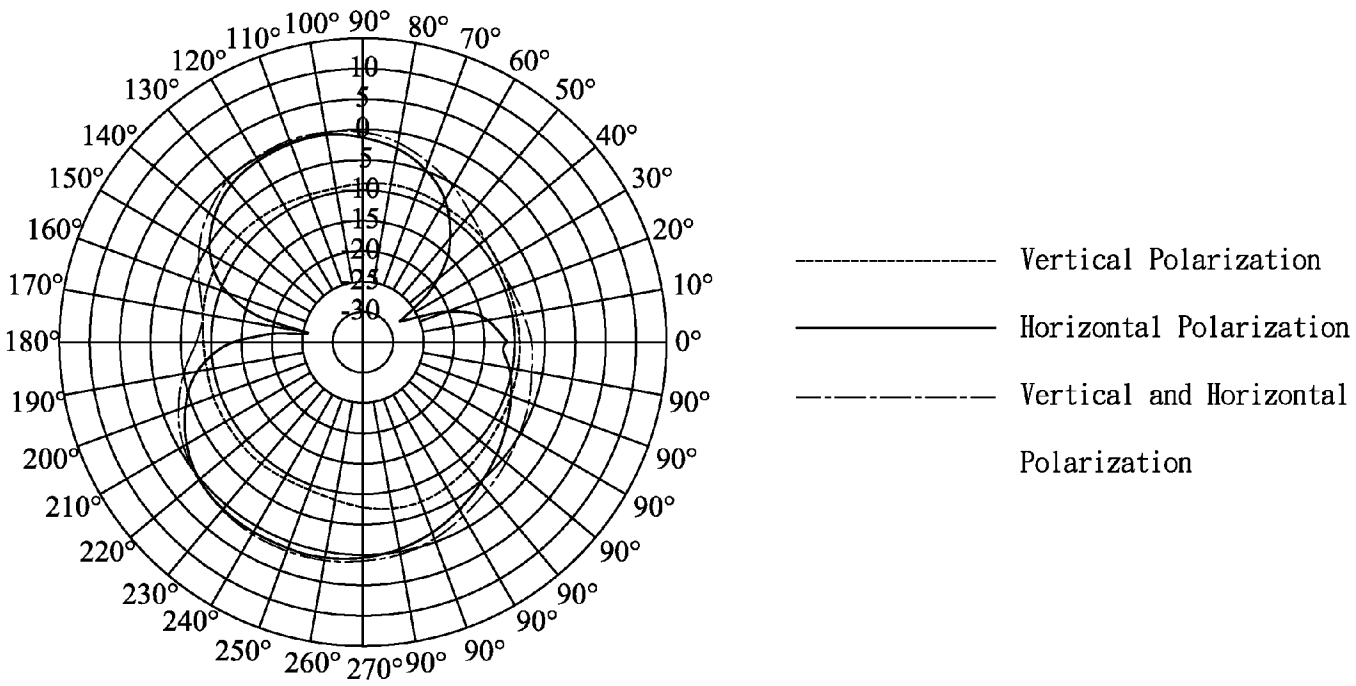
FIG. 5B shows the field pattern of a single-band antenna at 2.45 GHz on the X-Y plane according to the preferred embodiment of the present invention.
Figure 5C:
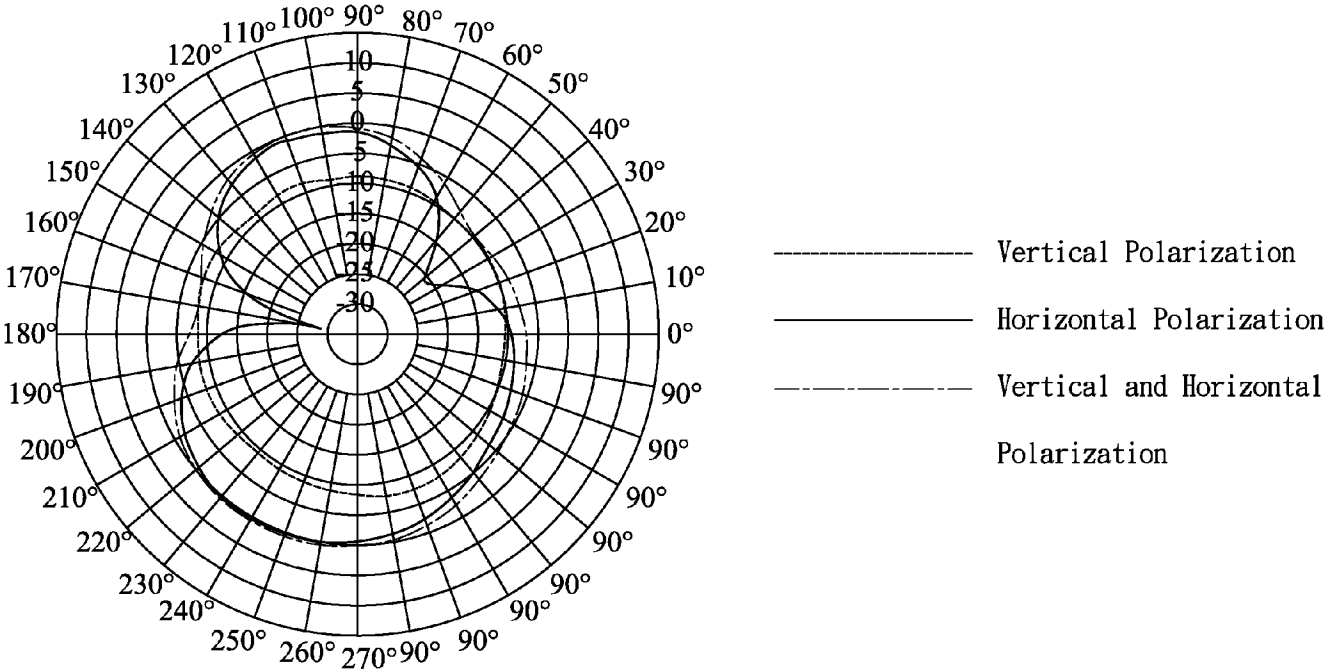
FIG. 5C shows the field pattern of a single-band antenna at 2.5 GHz on the X-Y plane according to the preferred embodiment of the present invention.

FIG. 5A to FIG. 5C show the field pattern of a single-band antenna at 2.4 GHz, 2.45 GHz and 2.5 GHz on the X-Y plane according to the preferred embodiment of the present invention. In FIG. 5A to FIG. 5C, the single-band antenna of the present invention exhibits excellent transceiving performances on various planes and along various orientations.

Figure 6A:
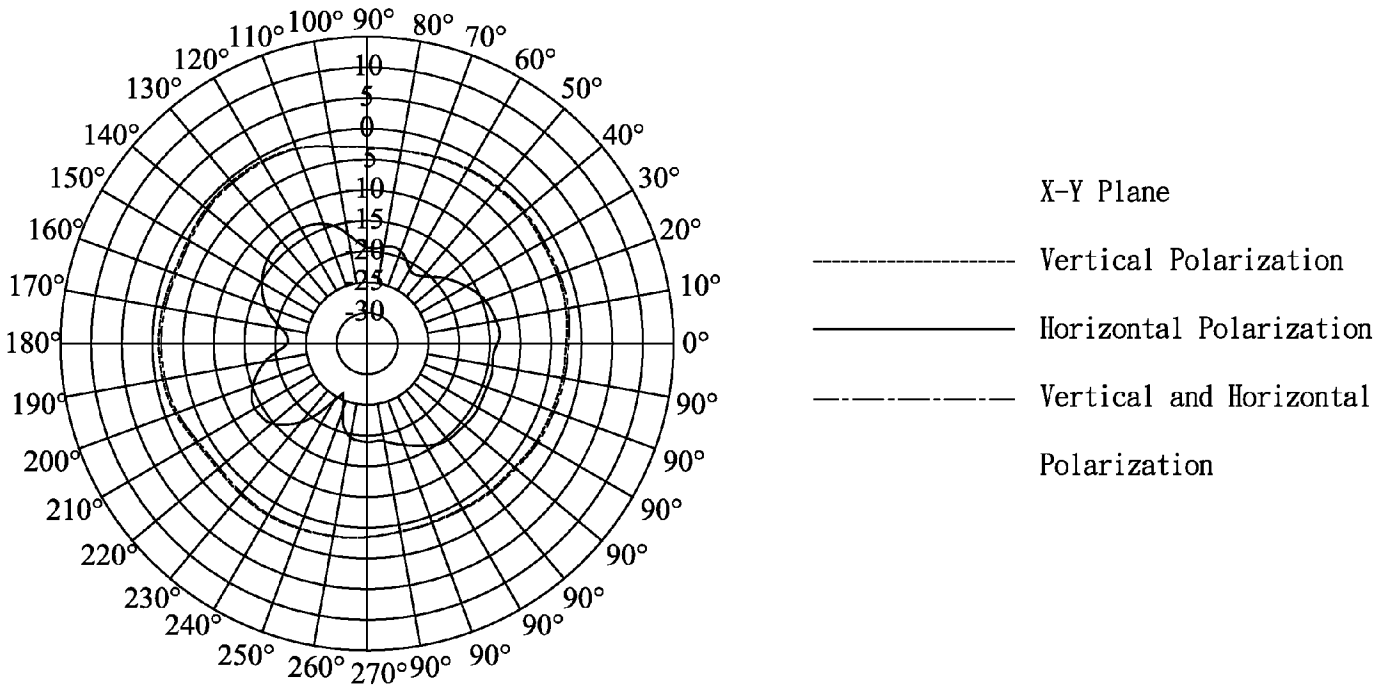
FIG. 6A shows the field pattern of a single-band antenna at 2.4 GHz on the Y-Z plane according to the preferred embodiment of the present invention.
Figure 6B:
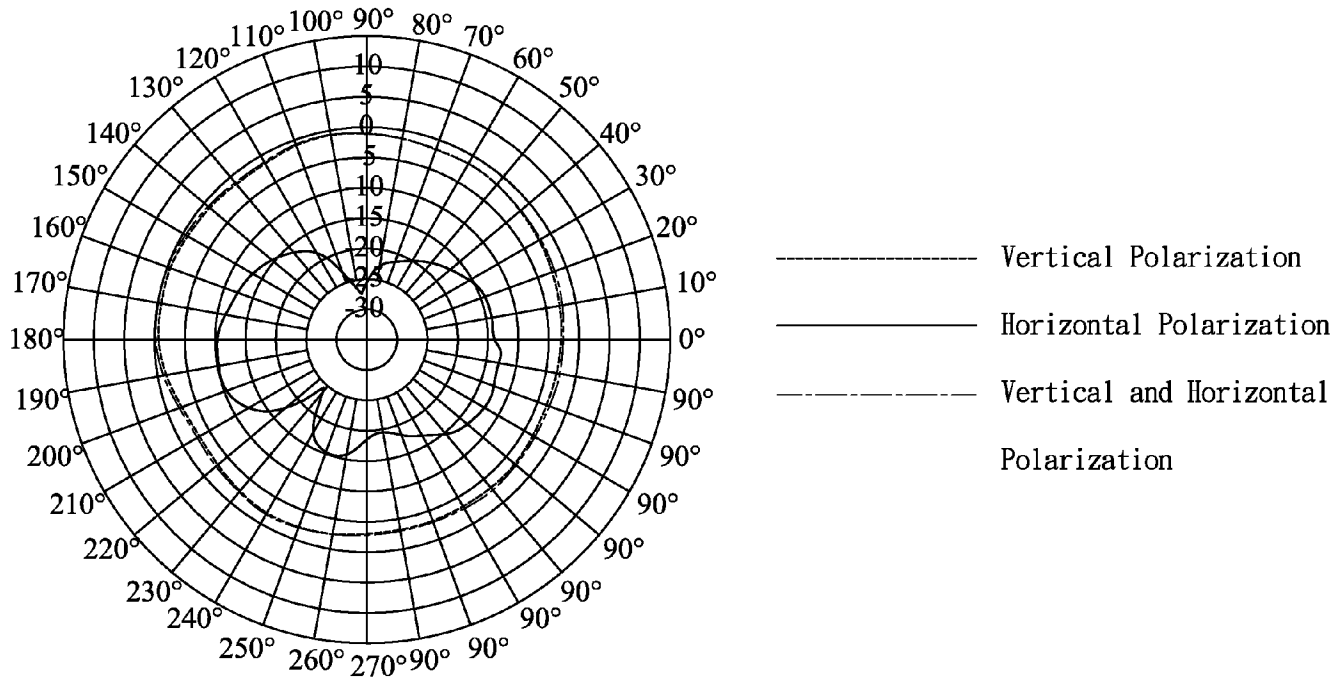
FIG. 6B shows the field pattern of a single-band antenna at 2.45 GHz on the Y-Z plane according to the preferred embodiment of the present invention.
Figure 6C:
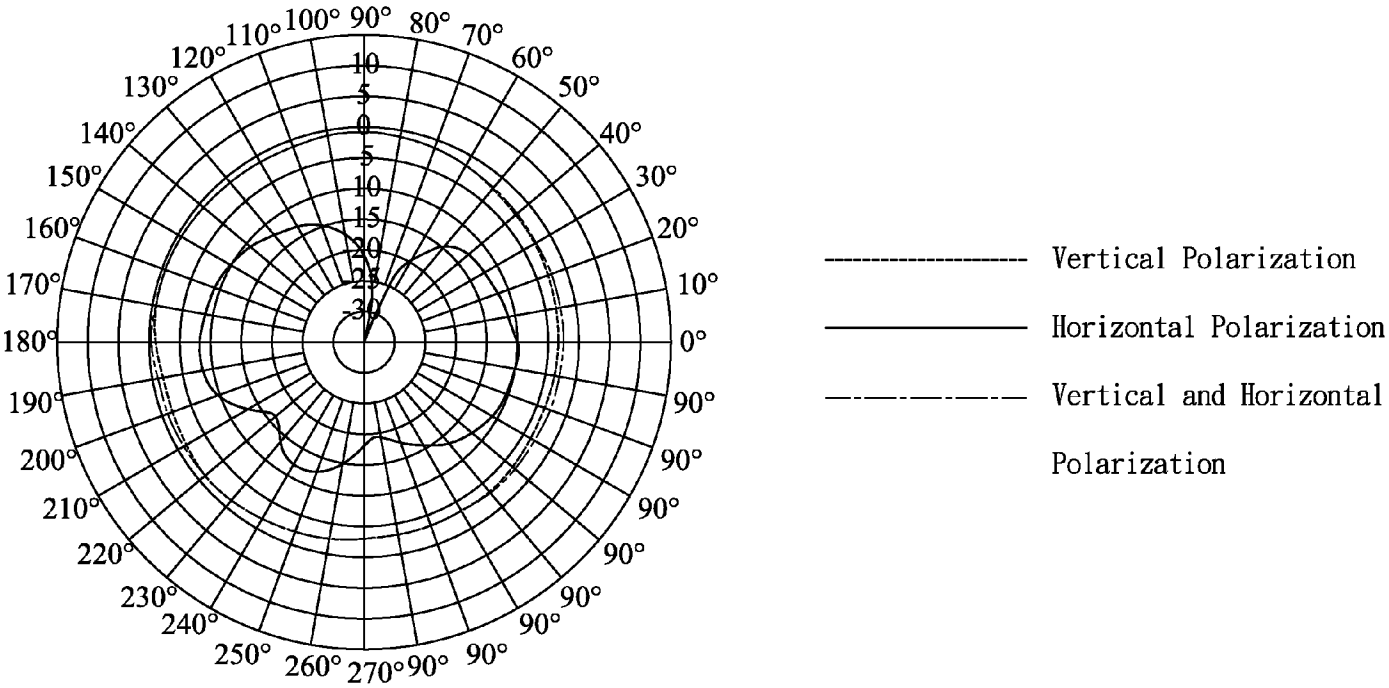
FIG. 6C shows the field pattern of a single-band antenna at 2.5 GHz on the Y-Z plane according to the preferred embodiment of the present invention.

FIG. 6A to FIG. 6C show the field pattern of a single-band antenna at 2.4 GHz, 2.45 GHz and 2.5 GHz on the Y-Z plane according to the preferred embodiment of the present invention. In FIG. 6A to FIG. 6C, the single-band antenna of the present invention exhibits excellent transceiving performances on various planes and along various orientations.

Accordingly, the present invention provides a single-band antenna antenna that can be miniaturized to be installed with or inside a compact wireless transmission device with enhanced transceiving performance. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A single-band antenna, comprising:

a substrate being provided with a first side and a second side;

a first radiation unit being a zig-zag pattern disposed on the first side;

a conductive material being disposed on the first side;

an impedance matching circuit being disposed on the first side to electrically connect the first radiation unit and the conductive material;

a signal feed-in terminal being disposed on the first side and being coupled to the first radiation unit;

a second radiation unit being disposed on the second side; and a wire connecting unit being disposed in the substrate to electrically connect the first radiation unit and the second radiation unit.

2. The single-band antenna as recited in claim 1, wherein the first side and the second side are two symmetric planes of the substrate.

3. The single-band antenna as recited in claim 1, wherein the first side and the second side are symmetric and non-coplanar.

4. The single-band antenna as recited in claim 1, further comprising a coaxial cable electrically connected to the signal feed-in terminal for signal transmission.

5. The single-band antenna as recited in claim 1, further comprising a micro-strip line electrically connected to the signal feed-in terminal for signal transmission.

6. The single-band antenna as recited in claim 1, further comprising a coplanar waveguide electrically connected to the signal feed-in terminal for signal transmission.

7. The single-band antenna as recited in claim 1, wherein the substrate, the first radiation unit, the conductive material, the impedance matching circuit and the signal feed-in terminal are formed in one process.

8. The single-band antenna as recited in claim 1, wherein the substrate is a printed circuit board.

9. The single-band antenna as recited in claim 1, wherein the first radiation unit comprises a first terminal and a second terminal and the zig-zag pattern is disposed between the first terminal and the second terminal.

10. The single-band antenna as recited in claim 9, wherein the wire connecting unit is connected to the first terminal of the first radiation unit.

11. The single-band antenna as recited in claim 9, wherein the signal feed-in terminal is connected to the second terminal of the first radiation unit.

12. The single-band antenna as recited in claim 1, wherein the impedance matching circuit and the first radiation unit are connected near the signal feed-in terminal.

13. The single-band antenna as recited in claim 1, wherein the conductive material is a grounding plane.

* * * * *